US005108878A

United States Patent [19]

Nakamura

[11] Patent Number: 5,108,878

[45] Date of Patent: Apr. 28, 1992

[54] METHOD FOR PROCESSING SILVER HALIDE PHOTOSENSITIVE MATERIAL

[75] Inventor: Takashi Nakamura, Minami-ashigara, Japan

[73] Assignee: Fuji Photo Film Co., Ltd., Kanagawa, Japan

[21] Appl. No.: 651,708

[22] Filed: Feb. 6, 1991

[30] Foreign Application Priority Data

Feb. 7, 1990 [JP] Japan ..... 2-27875

[51] Int. Cl.[5] ..... G03C 5/39

[52] U.S. Cl. ..... 430/421; 430/372; 430/393; 430/428; 430/430; 430/455; 430/460; 354/322; 354/324

[58] Field of Search ..... 430/372, 428, 430, 421, 430/455, 460, 393, 400; 354/322, 324

[56] References Cited

U.S. PATENT DOCUMENTS 5,040,013 8/1991 Kurokawa et al. ..... 354/322

5,066,570 11/1991 Nakamura et al. ..... 430/421

*Primary Examiner*—Hoa Van Le

*Attorney, Agent, or Firm*—Sughrue, Mion, Zinn, Macpeak & Seas

[57] ABSTRACT

A silver halide photosensitive material after exposure can be efficiently processed in a multi-compartment apparatus comprising a series of processing compartments interconnected through narrow channels to define a continuous processing path, by passing the photosensitive material through the series of compartments along the path. Two or more processing solutions of different compositions are supplied to the path at different positions to fill the compartment with the solutions, while the solution is discharged from the path through an outlet port at an intermediate position. During a quiescent period, the solution is discharged such that the compartment which the photosensitive material first enters and the compartment from which the photosensitive material exits become empty. Operation is restarted by refilling the entrance and exit compartments with fresh solutions.

6 Claims, 5 Drawing Sheets

METHOD FOR PROCESSING SILVER HALIDE PHOTOSENSITIVE MATERIAL

CROSS-REFERENCE TO RELATED APPLICATIONS

Reference is hereby made to the following copending U.S. Patent applications dealing with related subject matter and assigned to the assignee of the present invention:

Ser. No. 340,820 filed Apr. 20, 1989, for "Method and Apparatus for Processing Photosensitive Material" by Nakamura and Kurokawa, Ser. No. 499,746 filed Mar. 27, 1990, for "Photo. sensitive Material Processing Apparatus" by Nakamura and Kurokawa, Ser. No. 600,933 filed Oct. 22, 1990, for "Wet Processing of Silver Halide Photosensitive Material" by Nakamura and Kurokawa, and Ser. No. 502,888 filed Apr. 2, 1990, for "Photo. sensitive Material Processing Apparatus" by Kurokawa and Nakamura.

FIELD OF THE INVENTION

This invention relates to a method for processing silver halide photosensitive material.

BACKGROUND OF THE INVENTION

In general, silver halide photosensitive materials (to be simply referred to as photosensitive materials, herein. after), after exposure, are typically processed through a series of steps including development, desilvering, washing and stabilization. Usually use is made of developer for the development, bleaching solution, bleach-fixing solution or fixing solution for the desilvering, city water or deionized water for the washing, and stabilizer for the stabilization. The photosensitive materials are dipped and processed in these processing solutions which are adjusted to temperatures of 30° to 40° C.

A typical arrangement for such processing includes a plurality of juxtaposed processing tanks filled with the respective solutions wherein photosensitive materials are successively passed through the tanks. Most often, automatic developing machines or similar processors are used for such processing.

In recent years, environmental maintenance and resource saving are of general concerns. It is desirable to reduce the amount of processing solutions used in the processing of photosensitive materials.

In accordance with the current development of a small. scale processing system generally known as mini-labo, photo. sensitive materials are processed at photo stores. There is a need for smaller size processors.

The inventors previously proposed an apparatus for processing a photosensitive material comprising a plurality of washing compartments defined by block-shaped members and interconnected through narrow channels and means for transferring the photosensitive material successively through the washing compartments as disclosed in Japanese Patent Application No. 27034/1989. A photosensitive material processing apparatus of similar construction, but adapted for development, desilvering or the like is also proposed in Japanese Patent Application No. 90422/1989. These apparatus have several advantages including a size reduction, more efficient processing, and a reduced amount of processing solution used. Although these apparatus have the above-mentioned advantages over the prior art processors, a problem arises that a single tank cannot accommodate plural types of processing because the compartments of the tank are filled with processing solutions having at least an identical function.

A further approach the inventors proposed in Japanese Patent Application No. 99855/1989 is a photosensitive material processing apparatus of the same construction wherein at least one discharge port is positioned at a position other than the entrance and exit compartments that the photosensitive material enters first and last, respectively. This arrangement allows a single tank to accommodate plural types of processing by changing the position and number of discharge ports, resulting in a reduction in both the amount of processing solutions used and the size of the apparatus.

In the processing of color photosensitive materials, the desilvering step following color development is a critical step and often requires a plurality of processing baths such as bleaching-fixing baths and bleaching-blix-fixing baths, particularly for color negative films and other picture-taking color photosensitive materials which are normally less susceptible to desilvering. Therefore, it has heretofore been required to use a plurality of processing tanks in accordance with the types of processing baths, causing a bar to apparatus size reduction.

In this regard, it is quite effective to apply the apparatus of the above-mentioned Japanese Patent Application No. 99855/1989 to the desilvering process requiring a plurality of processing baths. Arrangements for such application are proposed in Japanese Patent Application Nos. 133395/1989 and 212790/1989.

Further studying the desilvering process and subsequent steps such as washing and stabilization, the inventors have discovered that if so-called occasional processing adapted for relatively small quantities of photosensitive material is continued over a long time, there eventually results a situation where sufficient photographic properties cannot be achieved and a problem of poor desilvering often arises.

SUMMARY OF THE INVENTION

Therefore, an object of the present invention is to provide a method for processing a silver halide photo sensitive material which can improve the processing efficiency, reduce the amount of processing solution used and the size of the apparatus, and ensure the production of images of better photographic quality even under the condition intended for processing relatively small quantities of photosensitive material.

These and other objects are attained by the present invention which provides a method for processing a silver halide photosensitive material after exposure comprising the steps of: providing a continuous processing path comprising a series of processing compartments interconnected through narrow channels, supplying at least two processing solutions of different compositions to the path at different positions to fill the compartments with the solutions, discharging the solution from the path through an outlet port at an intermediate thereof, and passing the photosensitive material through the series of compartments along the path. The compartments include the entrance compartment which the photosensitive material first enters and the exit compartment from which the photosensitive material exits to outside the apparatus. According to the invention, the solution is discharged during a quiescent time, that is, when no photosensitive material is being processed, such that the entrance and exit compartments become empty.

According to the invention, a continuous processing path having a series of processing compartments interconnected through narrow channels is defined in a tank. At least two processing solutions of different compositions are supplied to the path at different positions, while the solution is discharged from the path through an outlet port at an intermediate of the path. As a result, the compartments are filled with the solutions of different compositions. This permits corresponding plural types of processing to be effected in the common tank and leads to a size reduction of the apparatus. There are obtained many advantages including a minimized dead space in the tank, higher processing efficiency, and a reduced amount of processing solution used, which also promises a size reduction of the apparatus.

If all the compartments are kept charged during the quiescent time, the solution portions in the respective compartments intermix with the adjacent ones. After the re start of operation, the "aged" solutions in the respective compartments are more or less deviated from the desired compositions even when fresh process solutions are replenished in time, resulting in images of poor photographic quality.

The approach of the present invention is to discharge the solution during a quiescent time such that the entrance and exit compartments become substantially empty. Upon re start of operation, fresh processing solutions should be replenished at least in amounts corresponding to the volume of one compartment, ensuring better photographic performance. Since the increase in the amount of processing solution replenished is only as small as the volume of one compartment, the discharging during a quiescent time does not cause a substantial increase in the amount of processing solution used as a whole. The benefits of the invention become more particularly in the occasional processing mode adapted for relatively small quantities of photosensitive material.

DESCRIPTION OF THE PREFERRED EMBODIMENTS

Figure 1:
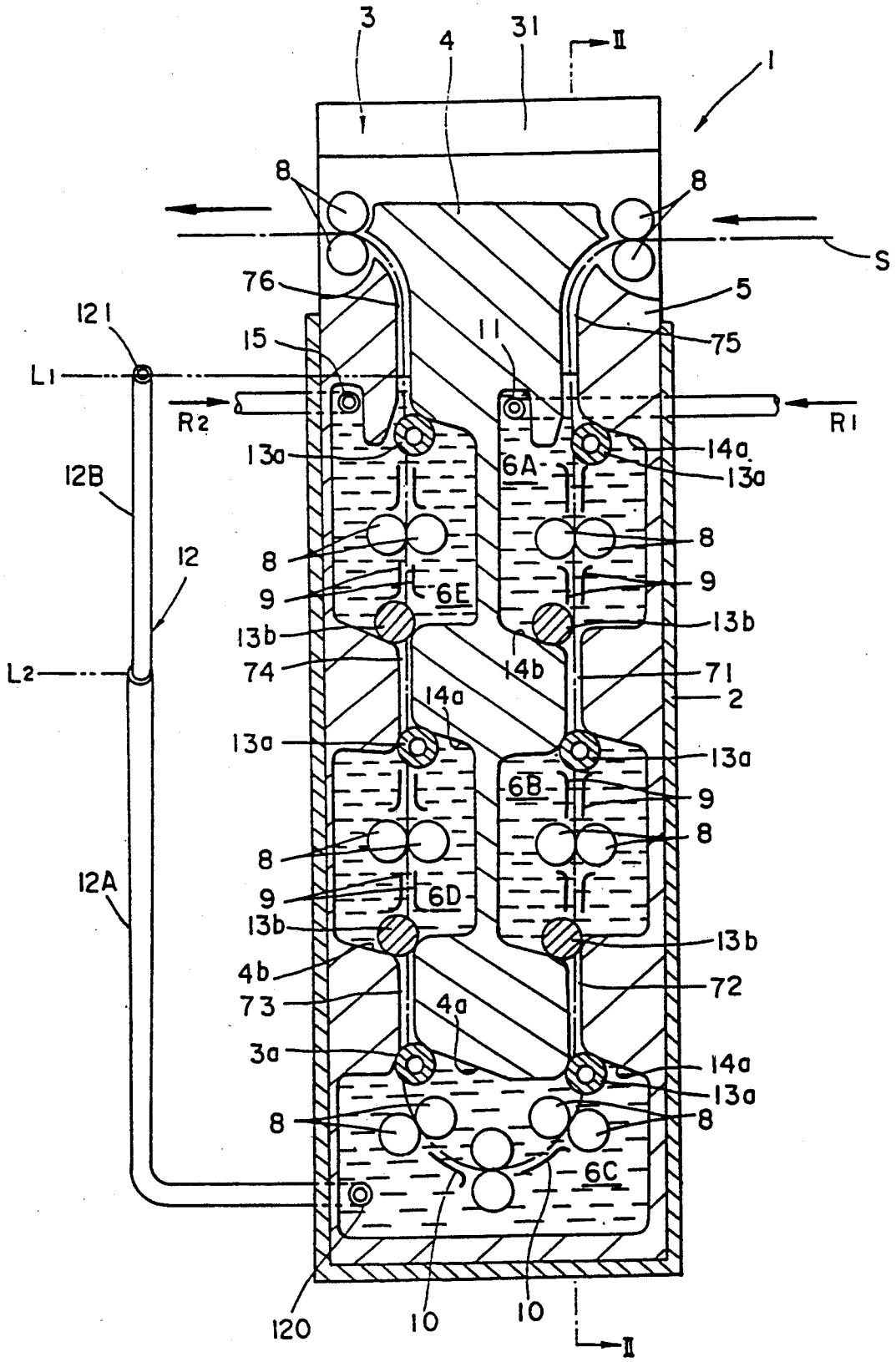
FIG. 1 is an elevational cross section of a processing apparatus for use in the practice of the present invention.
Figure 2:
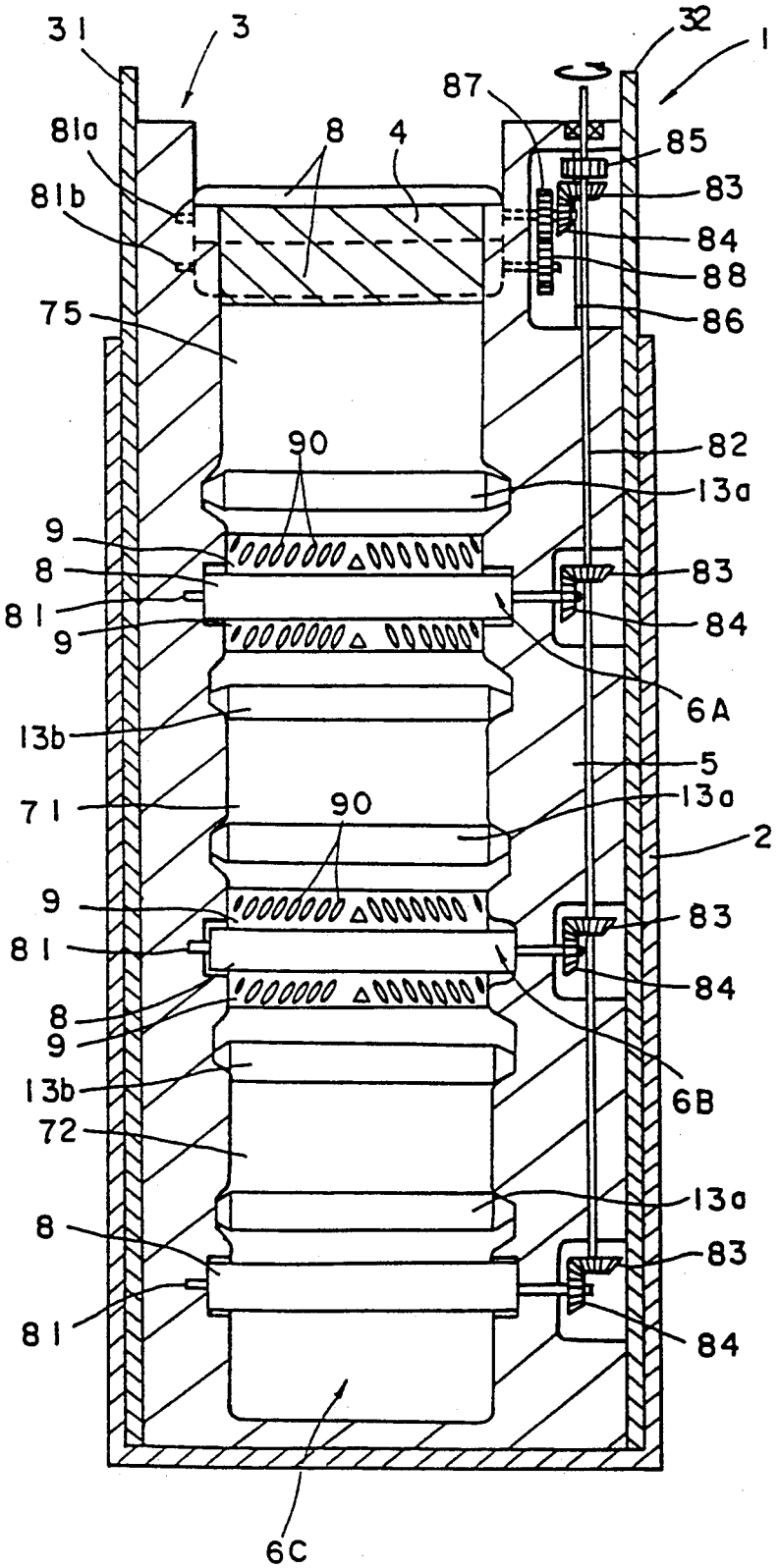
FIG. 2 is a cross section taken along lines II—II in FIG. 1.

Referring to FIGS. 1 and 2, there is illustrated a processing apparatus or tank having a processing solution received therein which is useful in the practice of the method for processing silver halide photosensitive material according to the present invention. The processing apparatus 10 shown in FIGS. 1 and 2 includes an vertical elongated tank 2 of a predetermined interior volume. The processing tank 2 has a rack assembly 3 accommodated therein, which includes configured members or blocks 4 and 5 mounted between side plates 31 and 32.

The blocks 4 and 5 may be formed of a rigid material which is chemically resistant against the processing solution, for example, plastic materials such as polyethylene, polypropylene, polyphenylene oxide (PPO), acrylo nitrile-butadiene-styrene (ABS) resins, phenol resins, polyester resins, and polyurethane resins, ceramics such as alumina, and metals such as stainless steel and titanium. Plastic materials such as polypropylene, PPO, ABS are preferred for ease of molding, light weight, and strength. The blocks 4 and 5 are either solid members as in the illustrated embodiment or hollow members which may be molded from resins or the like by blow molding.

The block 4 is disposed inside the block 5. With the blocks 4 and 5 mated, five processing compartments 6A, 6B, 5, 65 and 6E are defined therebetween as spaces for processing a silver halide photosensitive material S (typically in the form of a length of film or discrete sheets). Narrow channels 71, 72, 73 and 74 are defined between two adjoining compartments 6A and 6B, 6B and 6C, 6C and 6D, and 6D and 6E for fluid communication therebetween. In this way, a series of compartments 6A to 6E are successively interconnected through narrow channels 71 to 74 to define a continuous processing path. The compartments 6A to 6E are filled with processing solutions as will be described later while photosensitive material S is passed through the path.

Further similar narrow channels 75 and 76 are defined above the compartments 6A and 6E for carrying the photo. sensitive material S into and out of the tank or processing solution. The transverse width of channels 71 to 76 (as viewed in FIG. 1) is preferably 5 to 40 times the thickness of photosensitive material S. The channels of such width permit smooth travel of photosensitive material S. For facilitated passage, the channels 71 to 76 on the opposed surfaces may be treated to be water repellent.

Where the path is not provided with shutter means to be described later, the channels 71 to 76 may have the same transverse width as mentioned above, but is preferably increased in length.

Disposed approximately at the center in each of the processing compartments 6A, 6B, 6D, and 6E are a pair of feed rollers 8. Three pairs of feed rollers 8 are disposed in the processing compartment 6C. Disposed in proximity to the entrance of the channel 75 are feed rollers 8 for carrying the photosensitive material S into the tank. Disposed in proximity to the exit of the channel 76 are feed rollers 8 for carrying the photosensitive material S out of the tank. The feed rollers 8 are pivotally supported to the block 4 or 5 such that either or both of the paired rollers are driven for rotation to carry the photosensitive material S forward while clamping it therebetween.

The drive mechanism for the rollers 8 is illustrated in FIG. 2 as including a vertical drive shaft 82 received in the block for rotation and bevel gears 83 fixedly secured to the shaft 82 at predetermined positions. Each of the feed rollers 8 includes a rotating shaft 81 having a bevel gear 4 fixedly secured to one end thereof in mesh with the bevel ear 83 on the drive shaft 82. Then, each feed roller 8 can be rotated by rotating the drive shaft 82 in a predetermined direction by means of a suitable drive such as a motor (not shown).

One loading roller 8 at the top has a rotating shaft la offset from the drive shaft 82. A driven shaft 86 is supported parallel to the drive shaft 82 and coupled to the drive shaft 82 through a gear train including a gear 85 fixedly secured to the drive shaft 82. A bevel gear 83 fixedly secured to the driven shaft 86 is in mesh with another bevel gear 84 fixedly secured to the shaft 81*a* of one roller at one end thereof for rotating the shaft 81*a*. The roller shaft 81*a* also has a rear 87 secured thereto inside the bevel gear 84, which is in mesh with a gear 88 secured to the shaft 81*b* of the other roller 8 at one end thereof. Then both the rollers 8 are simultaneously rotated.

For each pair of feed rollers 85 in the processing compartment, one roller is driven for rotation and the other roller is rotated therewith due to frictional engagement between their peripheral surfaces. It is possible to couple the rollers of each pair through gears so that both the rollers are driven for rotation.

The rollers are preferably formed of a material which is durable and chemically resistant against the processing solution, for example, various rubbers such as neoprene rubber and EPT rubber; elastomers such as Sunprene®, Thermolan®, and Hytrel®; various resins such as rigid polyvinyl chloride, polypropylene, polyethylene, ABS resins, PPO, nylon, POM, phenol resins, silicone resins, and Teflon®; ceramics such as alumina; and corrosion resistant metals such as stainless steel, titanium, and Hastelloy, and a mixture thereof.

Disposed above and below the feed rollers 8 in each of the compartments 6A, 6B, 6D and 6E are two pairs of guide plates 9 for guiding the photosensitive material S. Disposed between the feed rollers 8 in the compartment 6C are reverse guides 10 in the form of an arcuate plate for assisting in reversing the travel direction of the photo sensitive material S. These guide members 9 and 10 may be of sheet metal or molded plastic material.

Often the guide members are formed with perforations 90 distributed approximately uniformly thereon as shown in FIG. 2. The perforations 90 in the guide members 9 and 10 allow passage of the processing solution therethrough, resulting in promoted circulation of the processing solution and increased processing efficiency.

The guide members 9, 10, feed rollers 8, and their drive mechanism form means for transferring the photo sensitive material S along the path.

The processing compartment 6A is designated entrance compartment since it is located at the first state of the continuous processing path where the photosensitive material S enters first. The processing compartment 6E is designated exit compartment since it is located at the last stage of the path where the photosensitive material S enters last and exits from the path. A first inlet port 11 for supplying a bleaching solution R1 is located at the top of the entrance compartment 6A where the surface of solution is situated. A second inlet port 15 for supplying a fixing solution R2 is located at the top of the exit compartment 6E where the surface of solution is situated. The first and second ports 11 and 15 are located on substantially the same level.

In the processing compartment 6C which is located at an intermediate of the path, there is present a substantial bleach-fixing solution resulting from intermixing of the bleaching and fixing solutions. An outlet port 120 is located in the intermediate compartment 6C and connected to a discharge tube 12 for discharging the bleach-fixing solution in an overflow manner. The discharge tube 12 extends vertically upward and terminates at an opening 121 from which the solution overflows.

The opening 121 of the discharge tube 12 is variable in position between upper and lower positions such that it is at the upper position to maintain the solutions at level L1 during processing, but it is at the lower position during a quiescent time to cause the entrance and exit compartment 6A and 6E to be substantially emptied of the solutions, that is, to maintain the solutions at level L2.

Figure 3:
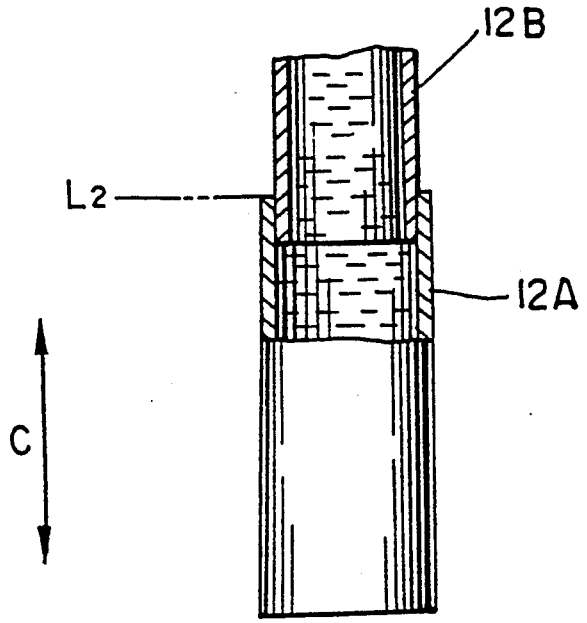
FIG. 3 is a partially cross-sectional view of the discharge tube used in the apparatus of FIG. 1.

The variable position opening design can be realized in any desired manner. For example, as shown in FIGS. 1 and 3, the discharge tube 12 is comprised of a first section of tubing 12A and a second section of tubing 12B of a smaller diameter than the first section of tubing 12A. The first and second sections of tubing 12A and 12B are telescopically connected such that the second section of tubing 12B is movable relative to the first section of tubing 12A in a vertical direction indicated by an arrow C in FIG. 3. When the second section of tubing 12 is fully extended as shown in FIG. 1, the opening 121 is at the upper position to maintain the solutions at upper level L1. When the second section of tubing 12 is fully retracted (not shown), the opening 121 in flush with the opening of the first section of tubing 12A is at the lower position to maintain the solutions at lower level L2. Movement of the opening 121 between the upper and lower positions may be carried out by means of a step motor or hydraulic cylinder in response to a signal associated with processing of photosensitive material. An alternate variable position opening design is the provision of an hole midway a single discharge tube which hole is controlledly opened or closed.

Disposed at the transitions between the processing compartments 6A to 6E and the channels 71 to 76 are shutter means for shutting or closing the transitions when no photo. sensitive material S travels, in the form of valves 13*a* and 13*b*. Both the valves 13*a* and 13*b* are in the form of a cylinder or roller having tapered or frustoconical portions at axially opposed ends as shown in FIG. 2, but they are somewhat different in detail.

The valve 13*a* has a lower specific gravity than the processing solution such that the valve may float up due to buoyancy for blocking the upper opening of each compartment 6A–6E. In contrast, the valve 13*b* has a higher specific gravity than the processing solution such that the valve may sink to the bottom for blocking the lower opening of each of the compartments 6A, 6B, 6D and 6E.

The specific gravity of valves 13*a* and 13*b* may be determined by a choice of proper material. When the valves 13*a* and 13*b* are solid cylinders, the valves 13*a* may be formed of a foamed plastic material such as foamed polypropylene, foamed PPO, and foamed ABS, and the valves 13*b* may be formed of a rigid plastic material such as rigid polyvinyl chloride, ABS resin and PPO. It is also possible to form the valves 13*a* from a material having a higher specific gravity than the processing solution by molding them as a hollow cylinder having buoyancy as shown in FIG. 1. As to the valves 13*b*, their overall specific gravity may be increased, if desired, for example, by inserting a core of metal or other heavy material (not shown).

From the point of view of providing an improved seal against the channels 71 to 76, it is preferred to form the valve cylinders 13*a* and 13*b* from an elastomeric material such as silicone rubber and various other elastomers or to cover the rolling periphery of the valves 13*a* and 13*b* with such elastomeric material.

These valves 13*a* and 13*b* block the access openings of the compartments to the channels 71 to 76 when no photo sensitive material S travels, but allow passage of photo. sensitive material S since the valves are moved aside by the incoming photosensitive material S to tumble along inclined surfaces 14*a* and 14*b* of blocks 4 and 5. After the photo. sensitive material S has passed, the valves 13*a* and 13*b* resume their original position to block the access openings of the compartments to the channels 71 to 76 again.

The shutter means associated with the compartments 6A to 6E is not limited to the illustrated embodiment. Other useful shutter designs include fluid shutters using fluid such as paraffin, liquid crystal and oil and shutters using magnetic fluid as disclosed in Japanese Patent Application No. 142464/1988; shutter members of the roller type as disclosed in Japanese Patent Application No. 94755/1988; shutter members of the squeezer type as disclosed in Japanese Patent Application No. 94756/1988; shutter plates movable by a crank mechanism as shown in FIG. 2 of Japanese Patent Application No. 27034/1989; and other packings, gaskets, and labyrinth seals.

The shutter means need not be provided in the tank because the interconnection through narrow channels can provide shutting effect to some extent without the shutter means.

In the illustrated embodiment, each compartment may have a volume of 20 to 3,000 ml, preferably 60 to 900 ml.

It is now described how to use and operate the processing apparatus of the above-mentioned construction.

Prior to the processing of photosensitive material S, bleaching solution R1 and fixing solution R2 are supplied through inlet ports 11 and 15, respectively. Supply of bleaching solution R1 and fixing solution R2 is conducted continuously or at intervals during processing by feeding their replenishers.

By supplying bleaching solution R1 and fixing solution R2 while discharging the solution from compartment 6C in an overflow fashion to maintain the solution level L1, the compartments 6A to 6E are substantially filled with processing solutions having a desilvering function in the following manner.

Compartment 6A: bleaching solution

Compartment 6B: blix solution having more bleaching components

Compartment 6C: blix solution

Compartment 6D: blix solution having more fixing components

Compartment 6E: fixing solution

The respective compartments are filled with processing solutions having a desilvering function because due to the characteristic design of the apparatus, little communication occurs between processing solutions in the compartments during quiescent periods and only slow communication occurs therebetween during processing of photosensitive material S. The term "little communication" means that the flow of the processing solution is substantially negligible, for example, a situation where the flow rate of the processing solution is at most 2 ml/min. The term "slow communication" means that the flow of the processing solution occurs slowly in approximately the same rate as the supply rate of replenishers or lower, for example, a situation where the flow rate of the processing solution is at a rate of 1 to 20 ml/min.

The bleaching solution flows in the same direction as the travel of photosensitive material S (parallel flow) while the flow of the fixing solution is in the opposite direction to the travel of photosensitive material S (counter flow). The parallel flow of the bleaching solution is effective in improving bleaching efficiency.

The counter flow of the fixing solution also contributes to an improvement in processing efficiency. It is rather preferable in processing efficiency to carry out substantial bleaching in the first or entrance compartment 6A and substantial fixation in the fifth or exit compartment 6E since the bleach-fixing process proceeds such that only fixation takes place in unexposed, undeveloped areas while bleaching takes place first and is followed by fixation in developed areas.

In addition, the exit compartment 6E is substantially filled with the fixing solution and free of the bleaching components, leading to a great reduction in the load on the subsequent washing step.

Therefore, as the photosensitive material travels forward along the continuous processing path including a series of compartments, bleaching takes place in at least the entrance compartment 6A, bleach-fixation takes place in the intermediate compartment 6C where the outlet port is located, and fixation takes place in at least the exit compartment 6E.

Since the remaining intermediate compartments 6B and 6D are filled with a bleach-fixing solution approximate to the bleaching solution and a bleach-fixing solution approximate to the fixing solution, respectively, desilvering with such solutions also takes place in addition to the bleaching, bleach-fixation, and fixation just mentioned above.

In this way, the desilvering process involving the steps of bleaching→blix→fixation can be carried out in the practice of the present invention.

The present invention can provide for efficient processing with only a single tank although the prior art apparatus requires at least three baths for such a desilvering process.

One reason for processing efficiency as compared with the use of a plurality of tanks is the elimination of the time taken for the crossover travel between the tanks (air passage time), which leads to a reduction of the processing time. Another reason is the elimination of contact of the photosensitive material with air during the passage through the apparatus.

Since the apparatus is of smaller size and the desilvering efficiency is improved for these and other reasons, the amounts of bleaching and fixing solutions replenished can be reduced.

The supply of bleaching and fixing solutions R1 and R2 as replenishers may be carried out in direct or delayed response to a signal associated with the processing of photosensitive material S.

During a quiescent time when no photosensitive material is processed, not only the replenishing operation is interrupted as often the case, but also the opening 121 of the discharge tube 12 is moved down to the lower position corresponding to level L2 whereby the solution is discharged from the compartment 6C until the entrance and exit compartment 6A and 6E are substantially emptied of the solutions. Although the illustrated embodiment is designed to discharge the solution until level L2 is reached, it is acceptable to discharge the solution to a less extent that the solutions remain partially in the compartments 6A and 6E or to a greater extent that the solutions remain partially in the next compartments 6B and 6D. Then the compartments 6A and 6E are substantially or completely empty.

The control system may be designed so as to actuate the movement of the opening 121 of the discharge tube 12 to the position for emptying the compartments 6A and 6E when the system does not receive a signal indicative of processing of photosensitive material beyond one hour, for example. Upon receipt of a signal indicative of processing of photo. sensitive material, the discharge tube opening 121 is moved back to the upper position capable of maintaining the solutions at the operating level L1, and fresh bleaching and fixing solutions are supplied to the entrance and exit compartments 6A and 6E before a new photosensitive material enters the apparatus.

The variable position discharge tube avoids problems associated with an occasional processing mode of processing a smaller quantity of photosensitive material as typified by a daily processing quantity of 0.01 to 0.5 square meter. If the solutions are left in the entrance and exit compartments 6A and 6E during a quiescent time, that is, the entrance and exit compartments 6A and 6E are kept full of the solutions having a degraded processing function, then upon restart of the operation, exchange of the aged or degraded solutions with fresh solutions is not quickly accomplished so that no satisfactory photographic quality is achieved. Also, the solutions in the respective compartments intermix spontaneously during the quiescent time. These problems are overcome by emptying the entrance and exit compartments 6A and 6E of their solutions. Images of good quality are produced without deficient desilvering and other faults.

Particularly, desilvering with a fresh solution at the initial stage is effective in deterring the desilvering deficiency. Desilvering with a fresh solution at the last stage is effective in further improving the processing efficiency.

The processing or desilvering with the illustrated apparatus is applicable to a photosensitive material which has been imagewise exposed and color developed. The desilvering process is followed by a washing and/or stabilizing step.

Figure 4:
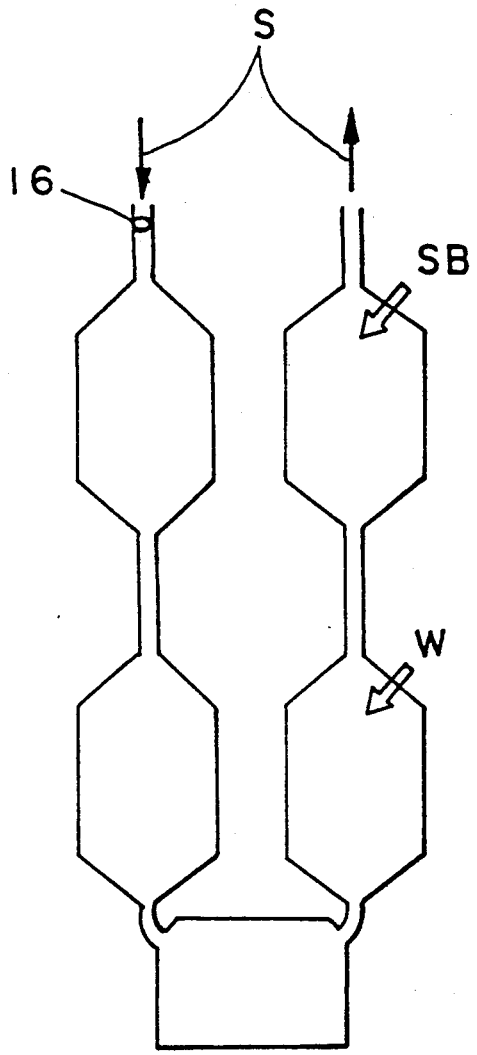
FIG. 4 is a schematic illustration of a processing apparatus used in combination with the apparatus of FIG. 1.

For the subsequent step, a processing apparatus as shown in FIG. 4 is preferably used. The tank of FIG. 4 is of essentially the same structure as the processing tank of FIGS. 1 and 2, and only the contour of compartments and channels is schematically illustrated in FIG. 4 with the tank, blocks, feed rollers, guides and the like omitted.

The washing tank of FIG. 4 is of essentially the same structure as the processing tank of FIGS. 1 and 2 except that no discharge tube is connected to a compartment intermediate the continuous processing path, but intended for washing and stabilization in a single tank. As illustrated by arrows, a stabilizer SB is delivered into the fifth or exit compartment and wash water W is delivered into the next or fourth compartment, while the solution is discharged through a discharge port 16 in a narrow channel above the first or entrance compartment in an overflow manner. For the detail of this processing tank, reference is made to Japanese Patent Application Nos. 27034/1989, 25132/1989, and 61707/1989.

In the washing step with the apparatus of such construction, wash water flows in the opposite direction to the travel direction of the photosensitive material, that is, counter flow. Since the wash fluid assumes counter flow and the flow of fluid through the compartments is approximately the same as in the apparatus of FIGS. 1 and 2, the active ingredients carried into the washing apparatus by the photosensitive material S are maintained at graded concentrations in the respective compartments. This keeps fresh the wash water W in the fourth compartment, leading to improved washing efficiency. Another reason for efficient washing is the elimination of contact of the photosensitive material with air during the passage through the apparatus. As a result of improved washing efficiency, the amount of wash water replenished can be reduced.

Further, the stabilizer SB flows from the fifth compartment to the fourth compartment and so forth and this flow is effective in achieving better photographic quality.

It will be understood that the apparatus of FIG. 4 may be encompassed within the scope of the present invention if the discharge port 16 is made variable in position so that the entrance and exit compartments may be emptied.

In the foregoing description, the processing apparatus for use in the practice of the invention is operated for desilvering purposes by supplying two processing solutions having a desilvering function in a broad sense, but different in composition. It is also contemplated to process with solutions which not only have different compositions, but have different functions in a broad sense. Such processing is carried out by the apparatus shown in FIG. 5, for example.

Figure 5:
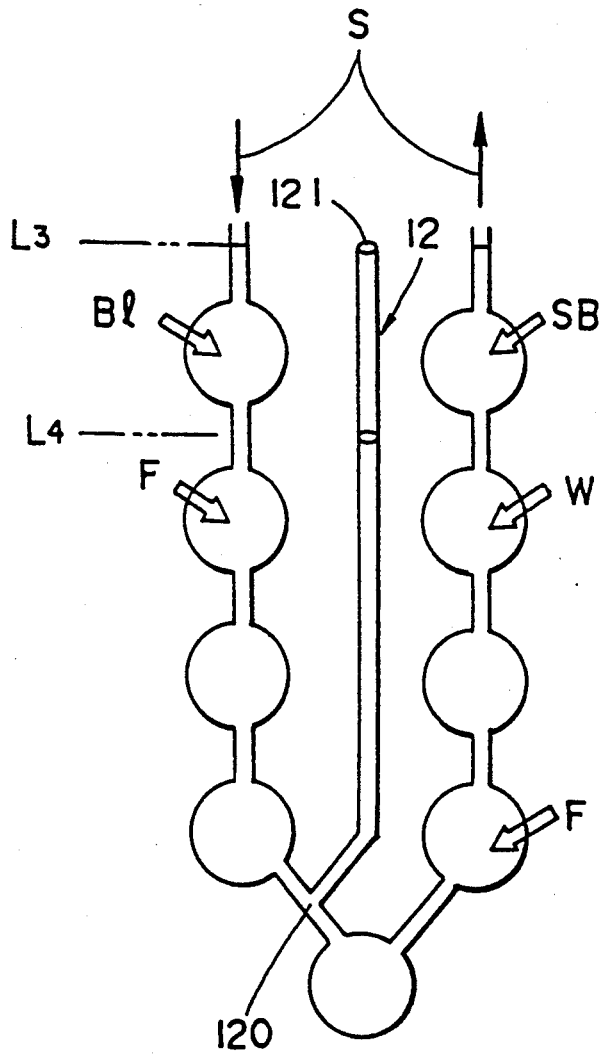
FIG. 5 schematically illustrates the outline pattern of a processing apparatus according to another embodiment of the present invention.

The apparatus of FIG. 5 is of essentially the same structure as the processing tank of FIGS. 1 and 2 except for the number of compartments and the location of a discharge port, and only the contour of compartments and channels is schematically illustrated in FIG. 5.

The apparatus shown in FIG. 5 includes nine compartments which are designated first to ninth compartments in accordance with the travel direction of photosensitive material S.

In the apparatus of FIG. 5, a bleaching solution B1 is delivered into the first compartment, a fixer F into the second and sixth compartments, wash water W into the eighth compartment, and a stabilizer SB into the ninth compartment. The solution is discharged in an overflow manner through a discharge tube 12 connected to the channel at 120 between the fourth and fifth compartments.

The discharge tube 12 has an opening 121 which is variable between upper and lower positions corresponding to liquid level L3 during processing and liquid level L4 during quiescent time. This arrangement can be the same as in the apparatus of FIGS. 1 and 2 and thus carries the same reference numerals as in FIG. 1.

The compartments are filled with processing solutions in the following manner.

1st compartment: bleaching solution
2nd compartment: blix solution (having higher bleaching activity)
3rd compartment: blix solution approximate to fixer
4th compartment: blix solution approximate to fixer (having lower bleaching activity)
5th compartment: fixer having blix solution partially mixed
6th compartment: fixer (having almost solely a fixing function)

7th compartment: wash water having stabilizer components introduced therein (having fixer partially mixed)

8th compartment: wash water having stabilizer introduced therein

9th compartment: stabilizer

In this way, the desilvering process involving the steps of bleaching→blix→fixation, and washing and stabilizing steps can be carried out in a single tank. The size of the entire apparatus and the entire processing time can be reduced.

Not only the same advantages for the desilvering process as previously described in the FIG. 1 embodiment are obtained, but also the amounts of processing solutions replenished including wash water can be reduced, resulting in a reduced amount of used solutions being discarded. The fixer F supplied in the illustrated mode is more effective in leaching the developing and oxidizing agents out of the emulsion layer, minimizing the occurrence of thermo-stains at the end of processing. It will be appreciated that the counter flow of wash water is effective in improving washing efficiency. The benefit of the flow of stabilizer from the 9th to the 8th compartment is the same as in FIG. 4.

The benefit of the variable position of the discharge tube opening 121 is the same as in FIGS. 1 and 2. This design enables processing with a fresh bleaching solution when the apparatus is restarted from the quiescent state to the processing state in the occasional processing mode, preventing the occurrence of desilvering deficiency. Also in the 9th compartment, processing is started with a fresh stabilizer, ensuring a better photographic finish.

In the apparatus illustrated in FIGS. 1 and 2 as well as that illustrated in FIG. 5, all the compartments are approximately equal in volume. The entrance compartment may have a smaller volume than the remaining compartments if desired in improving processing efficiency.

The present invention is applied to the desilvering process with or without the washing and stabilizing process in the foregoing embodiments. The present invention is applicable to any other combined process involving a color development step by changing the number and location of compartments and solution inlet and outlet ports. However, the present invention is most effective in the desilvering of color photosensitive materials and subsequent steps, especially in the desilvering.

Although both the compartments which are emptied during quiescent time are made up with processing solutions upon restart in the foregoing description, the benefits of the invention are obtained by making up a fresh solution to only one of the compartments. Replenishment of a fresh solution need not be limited to the compartments which have been empty, but can be made to another compartment(s).

The photosensitive materials which can be processed in the practice of the present invention include color and black-and-white photosensitive materials, for example, color negative films, color reversal films, color photographic paper, color positive films, and color reversal photographic paper as well as printing photographic photosensitive material, radiographic photographic photosensitive material, radiographic photosensitive material, black-and-white negative films, black-and-white photographic paper, and micrographic photosensitive material.

The invention is especially advantageous in processing color photosensitive materials, inter alia, color negative films and other picture taking color photosensitive materials having a higher iodine content emulsion.

The processing solutions which can be used in the practice of the invention are now described.

The processing solutions having a desilvering function used in the practice of the invention include bleaching, bleach-fixing and fixing solutions, which are now described.

The bleaching and bleach-fixing solutions used herein contain bleaching agents which include ferric ion complexes or complexes of ferric ion with chelating agents such as aminopolycarboxylic acids, aminopolyphosphonic acids, and salts thereof. The aminopolycarboxylic and aminopolyphosphonic salts are salts of aminopolycarboxylic acids and aminopolyphosphonic acids with alkali metals, ammonium, and water-soluble amines. The alkali metals include sodium, potassium, and lithium, and the water-soluble amines include alkyl amines such as methylamine, diethylamine, triethylamine, and butylamine, cycloaliphatic amines such as cyclohexylamine, aryl amines such as aniline and m-toluidine, and heterocyclic amines such as pyridine, morpholine, and piperazine.

Typical, non-limiting examples of the chelating agents such as aminopolycarboxylic acids, aminopolyphosphonic acids, and salts thereof include ethylenediamine tetraacetic acid, disodium ethylenediamine tetraacetate, diammonium ethylenediamine tetraacetate, tetra(trimethylammonium) ethylenediamine tetraacetate, tetrapotassium ethylenediamine tetraacetate, tetrasodium ethylenediamine tetraacetate, trisodium ethylenediamine tetraacetate, diethylenetriamine pentaacetic acid, pentasodium diethylenetriamine pentaacetate, ethylenediamine-N-(β-oxyethyl)-N,N',N'-triacetic acid, trisodium ethylenediamine-N-(β-oxyethyl)-N-N',N'-triacetate, triammonium ethylenediamine-N-(β-oxyethyl)-N,N',N'-triacetate, 1,2-diaminopropane tetraacetic acid, disodium 1,2-diaminopropane tetraacetate, 1,3-diaminopropane tetrracetic acid, diammonium 1,3-diaminopropane tetraacetate, nitrilotriacetic acid, trisodium nitrilotriacetate, cyclohexanediamine tetraacetic acid, disodium cyclohexanediamine tetraacetate, iminodiacetic acid, dihydroxyethylglycine, ethyl ether diamine tetraacetic acid, glycol ether diamine tetrracetic acid, ethylenediamine tetrapropionic acid, phenylenediamine tetraacetic acid, 1,3-diaminopropanol-N, N,N',N'-tetramethylenephosphonic acid, ethylenediamine-N, N,N',N'-tetramethylenephosphonic acid, and 1,3-propylenediamine-N, N,N', N'-tetramethylenephosphonic acid.

The iron ion complex salts may be used in the form of complex salts or formed in a solution by supplying a ferric salt such as ferric sulfate, ferric silver chloride, ferric nitrate, ferric sulfate ammonium, and ferric phosphate and a chelating agent such as aminopolycarboxylic acids and phosphonocarboxylic acids. For the complex salt form addition, one or more complex salts may be used. Where a complex salt is formed in a solution from a ferric salt and a chelating agent, one or more ferric salts may be used. In either case, the chelating agent may be used in excess amount than necessary to form a ferric ion complex salt. The preferred iron complexes are iron aminopolycarboxylate complexes.

The bleaching agent is generally added in an amount of 0.02 to 1 mol/liter, preferably 0.06 to 0.6 mol/liter.

The bleaching and bleach-fixing solutions may contain bleaching promoters if desired. Among many known examples of the useful bleaching promoters, compounds having a mercapto group or disulfide group are preferred for enhanced promotion, especially the compounds described in U.S. Pat. No. 3,893,858, German Patent No. 1,290,812, and Japanese Patent Application Unexamined Publication (JP-A) No. 95630/1978.

The bleaching and bleach-fixing solutions may further contain re-halogenating agents, for example, bromides (e.g., potassium bromide, sodium bromide and ammonium bromide), chlorides (e.g., potassium chloride, sodium chloride and ammonium chloride), and iodides (e.g., ammonium iodide). If desired, there may be added at least pH buffering agent selected from inorganic acids, organic acids and alkali metal and ammonium salts thereof, for example, boric acid, borax, sodium metaborate, acetic acid, sodium acetate, sodium carbonate, potassium carbonate, phosphorus acid, phosphoric acid, sodium phosphate, citric acid, sodium citrate, and tartaric acid, as well as anti-corrosion agents such as ammonium nitrate and guanidine.

The bleach-fixing and fixing solutions used herein contain fixing agents which are selected from well-known fixing agents which are water-soluble silver halide dissolving agents, for example, thiosulfates such as sodium thiosulfate and ammonium thiosulfate; thioether compounds such as ethylenebisthioglycolic acid and 3,6-dithia-1,8-octanediol, and thioureas, alone or in admixture of two or more. Also useful are special bleach-fixing solutions based on a fixing agent combined with a large amount of a halide such as potassium iodide as disclosed in JP-A 155354/1976. Preferred are thiosulfates, especially ammonium thiosulfate. The fixing agent is generally added in an amount of 0.3 to 2 mol/liter.

The bleach-fixing and fixing solutions used herein preferably has a pH in the range of 3 to 10, more preferably 5 to 9. A lower pH value below the range will enhance the desilvering ability, but promote the fatigue of the solution and conversion of cyan dyes into leuco form whereas a higher pH value above the range will retard desilvering and often leave stains. For pH adjustment, hydrochloric acid, sulfuric acid, nitric acid, acetic acid, bicarbonates, ammonia, potassium hydroxide, sodium hydroxide, sodium carbonate, potassium carbonate or the like may be added if desired.

The bleach-fixing solution may further contain various brighteners, defoaming agents or surface active agents, polyvinyl pyrrolidone, and organic solvents such as methanol.

The bleach-fixing and fixing solutions used herein may further contain preservatives in the form of sulfite ion-releasing compounds, for example, sulfites (e.g., sodium sulfite, potassium sulfite, and ammonium sulfite), bisulfites (e.g., sodium bisulfite, potassium bisulfite, and ammonium bisulfite), and metabisulfites (e.g., sodium metabisulfite, potassium metabisulfite, and ammonium metabisulfite). These compounds are added in amounts of about 0.02 to 0.05 mol/liter, more preferably 0.04 to 0.40 mol/liter calculated as sulfite ions. Although sulfites are common preservatives, ascorbic acid, carbonyl bisulfite adducts or carbonyl compounds may also be used.

In addition, buffer agents, brighteners, chelating agents, bactericides and other agents may be added if necessary.

The wash water used in the washing step may be city water and deionized water. Water may optionally contain well-known additives such as water softeners, bactericides or fungicides, and surface active agents.

The amount of wash water may vary over a wide range depending on the properties of the photosensitive material to be processed (for example, the type of coupler), water temperature, and other factors. Usually wash water is at pH 4 to 9, preferably at pH 5 to 8. Washing temperature and time also depend on the properties of the photosensitive material to be processed, but generally include 20 seconds to 10 minutes at 15° to 45° C., preferably 30 seconds to 5 minutes at 25° to 45° C.

The stabilizing solution used in the stabilization step contains a compound for stabilizing dye images. For example, the stabilizer contains aldehydes (e.g., formalin), buffering agents for adjusting the film to optimum pH for dye stabilization, and ammonium compounds. There may be added fungicides, bactericides, surface active agents, brighteners, film hardeners, chelating agents, magnesium and bismuth compounds or the like if desired.

The stabilizing conditions may be approximately the same as used for the washing purpose.

Development is carried out prior to the desilvering process using black-and-white and color developers. The black-and-white developers may contain well-known developing agents such as dihydroxybenzenes (e.g., hydroquinone), 3-pyrazolidones (e.g., 1-phenyl-3-pyrazolidone), and aminophenols (e.g., N-methyl-p-aminophenol) alone or in admixture.

The color developer used in color development is most often an alkaline aqueous solution containing a color developing agent. The color developing agents used herein are well-known primary aromatic amine developing agents, for example, phenylene diamines (e.g., 4-amino-N,N'-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidethylaniline, and 4-amino-3-methyl-N-ethyl-N-β-methoxylethylaniline).

The color developer may further contain pH buffer agents such as carbonate, borate and phosphate salts of alkali metals, development retarders and antifoggants.

If desired, there may be added water softeners, preservatives, organic solvents, development promoters, dye-forming couplers, competitive couplers, chemical fogging agents, auxiliary developing agents, thickeners, polycarboxylic acid chelating agents, antioxidants, alkali agents, solution aids, surface active agents, and defoaming agents.

The processing temperature at which the color developer is used preferably ranges from 30° to 50° C., more preferably from 33° to 42° C.

Where reversal development is applied in the present invention, there may be used a first black-and-white developer which contains various additives used in the black-and-white developers for the processing of black-and-white silver halide photosensitive materials.

The present invention is applicable to a variety of photosensitive material processing apparatus such as wet copying machines, automatic developing machines, printer processors, video printer processors, photographic print producing vending machines, and proof color paper processors.

EXAMPLES

Examples of the present invention are given below by way of illustration and not by way of illustration.

EXAMPLE 1

Using color negative films identified as sample C in Ample 3 of U.S. Pat. No. 4,963,474 and a modified version of color negative film automatic processor model FP 230P (manufactured by Fuji Photo-Film Co., Ltd.), running operation was carried out according to the following schedule over one month until the accumulative amount of color developer replenished reached 30 liters.

| Processing steps | Time | Temp. | Replenisher amount* | Tank volume |
|---|---|---|---|---|
| Color development | 3'15" | 37.8° C. | 16 ml | 10 l |
| Bleach | 30" | 38° C. | 5 ml | 5 l |
| Fix | 1' | 38° C. | 15 ml | 10 l |
| Wash (1) | 20" | 38° C. | counter flow** | 5 l |
| Wash (2) | 20" | 38° C. | 20 ml | 5 l |
| Stabilizing | 20" | 38° C. | 20 ml | 5 l |
| Drying | 1' | 55° C. | | |

*Volume of solution replenished per meter of 35-mm film.
**Washing in a counter flow mode from tank (2) to (1).

Each processing solution had the following composition.

Color Developer

| Ingredients | Mother | Replenisher |
|---|---|---|
| Diethylene triamine pentaacetate | 1.0 g | 1.1 g |
| 1-hydroxyethylidene-1,1-diphosphonic acid | 3.0 g | 3.2 g |
| Sodium sulfite | 4.0 g | 4.9 g |
| Potassium carbonate | 30.0 g | 30.0 g |
| Potassium bromide | 1.4 g | — |
| Potassium iodide | 1.5 mg | — |
| Hydroxylamine hydrogen sulfate | 2.4 g | 3.6 g |
| 4-(N-ethyl-N-β-hydroxyethylamino)-2-methylaniline hydrogen sulfate | 4.5 g | 7.2 g |
| Water totaling to | 1.0 l | 1.0 l |
| pH | 10.05 | 10.10 |

Bleaching solution

| Ingredients | Mother | Replenisher |
|---|---|---|
| Ammonium ferric 1,3-diaminopropane tetraacetate monohydrate | 144.0 g | 206.0 g |
| 1,3-diaminopropanetetraacetic acid | 2.8 g | 4.0 g |
| Ammonium bromide | 84.0 g | 120.0 g |
| Ammonium nitrate | 30.0 g | 30.0 g |
| Aqueous ammonia (27%) | 10.0 g | 1.8 g |
| Acetic acid (98%) | 51.1 g | 73.0 g |
| Water totaling to | 1.0 l | 1.0 l |
| pH | 4.3 | 3.4 |

Fixer

| Ingredients | Mother/Replenisher |
|---|---|
| Disodium ethylenediamine tetraacetate | 1.7 g |
| Sodium sulfite | 14.0 g |
| Sodium bisulfite | 10.0 g |
| Aqueous ammonium thiosulfate (70 w/v %) | 320.0 g |
| Water totaling to | 1.0 l |
| pH | 7.2 |

Washing liquid (common to mother and replenisher)

City water was passed through a mixed bed column loaded with an H type strong acid cation-exchange resin (Amberlite IR-120B by Rohm & Haas Co.) and an OH type anion-exchange resin (Amberlite IR-400) to reduce the calcium and magnesium ion concentrations to less than 3 mg/l. To the deionized water were added 20 mg/l of sodium isocyanurate dichloride and 0.15 g/l of sodium sulfate. This liquid was at pH 6.5 to 7.5.

| Stabilizer Ingredients | Mother/replenisher |
|---|---|
| Surface-active agent | 0.5 g |

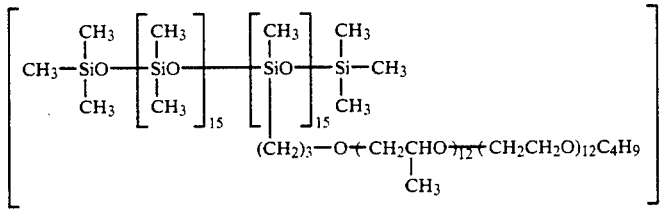

| | |
|---|---|
| Surface-active agent $C_{10}H_{21}—O—(CH_2CH_2O)_{10}—H$ | 0.4 g |
| Triethanolamine | 2.0 g |
| 1,2-benzisothiazolin-3-one | 0.01 g |
| Methanol | 0.3 g |
| Formalin (37%) | 1.5 g |
| Water totaling to | 1 liter |
| pH | 6.5 |

This procedure is designated Procedure 1A.

Good photographic quality was available at the end of 1-month running operation.

Procedure 1A was repeated except that the processing time from bleaching to stabilization was reduced by 10% in total as shown below. This procedure is designated Procedure 1A'.

| | Processing time |
|---|---|
| Bleaching | 25" |
| Fixing | 50" |
| Washing (1) | 20" |
| Washing (2) | 20" |
| Stabilizing | 20" |

Desilvering deficiency was observed in Procedure 1A'.

Running operation was carried out over one month according to Procedure 1A, but using the apparatus shown in FIG. 5 in which the opening 121 of the discharge tube 12 was fixed at the position of liquid level L3. The process from bleaching to stabilizing included the processing time and replenishing amount described below.

In this apparatus, the first compartment had a volume of 15 ml and the remaining compartments each had a volume of 300 ml. The flow rate of solution moving between the compartments was about 0.1 ml/min. during quiescent time and about 20 ml/min. during processing.

The apparatus was filled with the processing solutions as illustrated in FIG. 5 prior to the start of operation and the solutions were replenished during the operation.

| Step | Processing time | Replenishing amount |
|---|---|---|
| Bleaching | 12" | 5 ml (bleaching solution to 1st compartment) |
| Blix | 12" × 3 | 3 ml (fixer to 2nd compartment) |
| Fixing | 12" × 2 | 10 ml (fixer to 6th compartment) |
| Wash | 12" × 2 | 20 ml (water to 8th compartment) |
| Stabilizing | 12" | 20 ml (stabilizer to 9th compartment) |

This procedure is designated Procedure 1B. Procedure 1B took 72 seconds in the bleaching to fixation process, which was a 25% reduction as compared with 90 seconds for Procedure 1A, while good photographic quality was attained without desilvering deficiency. The replenisher amount used in the bleaching to fixation process was reduced by 10%.

Procedure 1B was tailored by operating under the same conditions for the initial three weeks, but then in an occasional processing mode for one month, the occasional processing mode being to process one roll of color negative film every three days. This procedure is designated Procedure 1C.

Desilvering deficiency was observed at the nd of one month running operation of Procedure 1C.

Procedure 1C was tailored by setting the apparatus of FIG. 5 in the occasional processing mode such that the opening 121 of the discharge tube 12 was moved down from upper level L3 to lower level L4 if the quiescent time when no processing signal was available exceeded 5 hours, and upon receipt of a processing signal, the opening 121 was moved back to upper level L3 and replenishers were supplied until the solution surface reached lever L3. This procedure is designated Procedure 1D.

No desilvering deficiency was observed in Procedure 1D.

Procedure 1D was repeated except that the processing time from bleaching to stabilization was reduced as shown below. This procedure is designated Procedure 1E.

| | Processing time |
|---|---|
| Bleaching | 11" |
| Blix | 11" × 3 |
| Fixing | 11" × 2 |
| Washing | 11" × 2 |
| Stabilizing | 11" |

Procedure 1E took a processing time from bleaching to fixation which was reduced about 30% as compared with Procedure 1A, while good photographic quality was attained without desilvering deficiency.

EXAMPLE 2

Procedure 1C of Example 1 was modified by carrying out the bleaching to fixation process with the apparatus shown in FIGS. 1 and 2, and the washing and stabilizing steps with the apparatus shown in FIG. 4.

The processing apparatus shown in FIGS. 1 and 2 was modified by adding a solution inlet port to the second compartment, and fixing the opening 121 of the discharge tube 12 at the upper position corresponding to liquid level L1. The compartments of the apparatus each had a volume of 800 ml and the flow rate of solution between compartments was approximately equal to that in FIG. 5.

The processing times and the amounts of solutions replenished in the bleaching to stabilization process were shown below.

| Step | Processing time | Replenishing amount |
|---|---|---|
| Bleaching | 12" | 5 ml (bleaching solution to 1st compartment) |
| Blix | 12" × 2 | 5 ml (fixer to 2nd compartment) |
| Fixing | 12" × 2 | 10 ml (fixer to 5th compartment) |
| Wash | 12" × 4 | 20 ml (wash water to 4th compartment) |
| Stabilizing | 12" | 20 ml (stabilizer to 5th compartment) |

This procedure is designated Procedure 2C. Desilvering deficiency was observed in Procedure 2C.

Procedure 2C was repeated using the apparatus shown in FIGS. 1 and 2 (with a solution inlet port added to the second compartment). The opening 121 of the discharge tube 12 was movable between liquid level L1 and L2 in accordance with Procedure 1D of Example 1. This procedure is designated Procedure 2D.

Procedure 2D took a processing time which was reduced about 30% as compared with Procedure 1A, while good photographic quality was attained without desilvering deficiency.

BENEFITS OF THE INVENTION

The present invention can reduce the quantity of processing solutions used and the size of the apparatus.

Due to the improved efficiency and reduced time of processing, the present invention insures better photographic quality to a long term running process in an occasional processing mode adapted for relatively small quantities of photosensitive material.

Although some preferred embodiments have been described, many modifications and variations may be made thereto in the light of the above teachings. It is therefore to be understood that within the scope of the appended claims, the invention may be practiced otherwise than as specifically described.

I claim:

1. A method for processing a silver halide photosensitive material after exposure comprising the steps of:

providing a continuous processing path comprising a series of processing compartments interconnected through narrow channels, supplying at least two processing solutions of different compositions to the path at different positions to fill the compartments with the solutions, discharging the solution from the path through an outlet port at an intermediate thereof, and passing the photosensitive material through the series of compartments along the path, the improvement comprising discharging the solution during a quiescent period such that the compartment which the photosensitive material first enters and the compartment from which the photosensitive material exits become substantially empty.

2. The method of claim 1 wherein the step of supplying at least two processing solutions of different compositions to the path at different positions includes supplying at least a bleaching solution and a fixing solution to the path at different positions to fill the compartments with the bleaching, bleach-fixing, and fixing solutions.

3. The method of claim 2 wherein a bleaching solution is supplied to the entrance compartment to fill the compartment therewith and a fixing solution is supplied to the exit compartment to fill the compartment therewith, whereby an intermediate compartment is filled with a bleach-fixing solution resulting from intermixing of the bleaching and fixing solutions, and the solution is discharged from the intermediate compartment during a quiescent period.

4. The method of claim 1 wherein the step of supplying at least two processing solutions of different compositions to the path at different positions includes supplying a bleaching solution to the entrance compartment to fill the compartment therewith and supplying a fixing solution to the compartment next to the entrance compartment so that the combined solution flows in parallel with the travel of the photosensitive material.

5. The method of claim 1 wherein a bleaching solution is supplied to the entrance compartment to fill the compartment therewith and a fixing solution supplied to the compartment next to the entrance compartment, a stabilizing solution is supplied to the exit compartment to fill the compartment therewith, wash water supplied to the compartment next to the exit compartment, and a fixing solution supplied to an intermediate compartment, the solution is discharged from the path at a location between the compartment next to the entrance compartment and the intermediate compartment receiving a fixing solution, whereby the combined solution on the entrance compartment side flows in parallel with the travel of the photosensitive material while the combined solution on the exit compartment side provides counter flow to the travel of the photosensitive material.

6. The method of claim 1 wherein the step of supplying at least two processing solutions of different compositions to the path at different positions includes supplying a stabilizing solution to the exit compartment to fill the compartment therewith and supplying wash water to the compartment next to the exit compartment so that the combined solution provides counter flow to the travel of the photosensitive material.

* * * * *